United States Patent [19]

Inamorato et al.

[11] 3,985,687

[45] Oct. 12, 1976

[54] LIQUID DETERGENT COMPOSITIONS OF CONTROLLED VISCOSITIES

[75] Inventors: Jack T. Inamorato, Westfield; William Chirash, New Providence, both of N.J.

[73] Assignee: Colgate-Palmolive Company, New York, N.Y.

[22] Filed: Dec. 26, 1974

[21] Appl. No.: 536,655

[52] U.S. Cl. ..... 252/551; 252/548; 252/553; 252/558; 252/559; 252/DIG. 14

[51] Int. Cl.[2] ..... C11D 1/14; C11D 1/22; C11D 1/831

[58] Field of Search ..... 252/DIG. 14, 551, 553, 252/558, 559

[56] References Cited

UNITED STATES PATENTS

| | | | |
|---|---|---|---|
| 3,346,873 | 10/1967 | Herrmann | 252/545 X |
| 3,440,171 | 4/1969 | Warren | 252/558 X |
| 3,554,916 | 1/1971 | Kerfoot et al. | 252/545 |
| 3,594,323 | 7/1971 | Taylor et al. | 252/545 X |
| 3,755,206 | 8/1973 | Verdier | 252/545 |
| 3,786,003 | 1/1974 | Hunter | 252/551 |
| 3,794,601 | 2/1974 | Kennedy | 252/355 |
| 3,808,156 | 4/1974 | Gorisch et al. | 252/545 |
| 3,812,041 | 5/1974 | Inamorato | 252/89 |
| 3,852,221 | 12/1974 | Bentley | 252/548 |
| 3,869,399 | 3/1975 | Collins | 252/118 |

OTHER PUBLICATIONS

Chem. Phys. Appl. Prat. Ag., Surface C. R. Congress Int. Deterg., 9-5-1968, pp. 849-851.

*Primary Examiner*—P.E. Willis, Jr.
*Attorney, Agent, or Firm*—Richard N. Miller; Murray M. Grill; Herbert S. Sylvester

[57] ABSTRACT

A liquid detergent of desired viscosity, conveniently pourable at room temperature and fluid at lower temperatures, includes polyethoxylated higher alkanol nonionic synthetic organic detergent, either polyethoxy higher alkanol sulfate or higher alkyl benzene sulfonate synthetic anionic organic detergent or a mixture of both, lower alkanol, sodium chloride, sodium nitrate and water, in certain proportions. The presence of the sodium chloride-sodium nitrate mixture allows the use of a lesser quantity of lower alkanol as a thinning and viscosity controlling agent, helps to maintain the liquid detergent pourable at room temperature and lower temperatures, and to avoid production of film on the surface of the detergent when a volume thereof is left exposed to air in an open container, and the salt mixture is essentially non-corrosive.

21 Claims, No Drawings

LIQUID DETERGENT COMPOSITIONS OF CONTROLLED VISCOSITIES

This invention relates to a liquid detergent which is of desired viscosity at its normal storage and use temperature (room temperature) and which is fluid at lower temperatures to which it might be subjected during shipment and storage before use. More particularly, the invention relates to a pourable, clear liquid laundry detergent including a combination of nonionic and anionic synthetic organic detergents, a lower alkanol, water and a mixed salt viscosity controlling agent which serves to thin the detergent to the desired room temperature viscosity range and to hold it in this range and also helps to prevent gelation at lower temperatures, such as those approaching the normal freezing point of water, thereby allowing the use of less alcohol in the formulation for this purpose. Such a liquid detergent, containing said viscosity control agent, is compatible with metals with which it may come into contact during manufacture, storage and use, despite its content of a normally corrosive salt.

Liquid detergents are known to possess many advantages over conventional dry powdered or particulate products and therefore have found substantial favor with consumers. However, they also possess certain inherent disadvantages which should be overcome to produce commercial products of good consumer acceptance. Thus, some liquid detergents separate out on storage and others separate out on cooling and are not readily redispersed. In some cases, as the product is cooled to near the freezing point but still above it, its viscosity may change and it may become either too thick to pour or so thin as to appear watery. Some clear detergents become cloudy and others gel and/or even become solid at low temperatures.

The problems of separation of detergent compositions are most severe when inorganic salts, such as the known detergent builder salts, are present with the normally largely organic detergents or detergent salts utilized. Therefore, by omitting builder salts and other inorganic salts from liquid detergent formulations the most serious separation problems encountered in the manufacture and storage of liquid laundry detergents may often be avoided. However, even such liquid detergents, unbuilt with inorganic salts (they may be built with organic builders) can be subject to viscosity problems and can gel as temperatures are lowered. Conventionally, such problems have been solved by the addition of an "anti-freeze" or solvent, e.g., ethanol, to the liquid detergent formulation.

The presence of the ethanol helps to maintan the clarity of the detergent, lowers the cloud point and often inhibits gelation or separation. Recently however, there has been a shortage of ethanol and it and other anti-freeze or solvent chemicals are on allocation in the United States and have become relatively expensive, making it important to conserve them and to limit the amounts used in liquid detergents and other products. Accordingly, efforts have been made to discover materials that may be added and formulations that may be produced to control liquid detergent viscosities.

It has been discovered that excellent commercial liquid detergents can be made based on a combination of a poly-lower alkoxylated higher alkanol nonionic synthetic organic nonionic detergent and a poly-lower alkoxylated higher fatty alcohol sulfate or a higher alkyl benzene sulfonate anionic detergent in an aqueous medium providing that a mixture of lower alkanol is present with a mixture of an inorganic halide and an inorganic nitrate, the combination of lower alkanol and such salts significantly controlling the viscosity of the particular type of liquid detergent described herein and allowing the use of less alcohol than would otherwise be needed to accomplish this purpose. In accordance with the present invention a liquid detergent having a viscosity in the range of 40 to 120 centipoises at 24° C. and which is fluid at 7° C. comprises from 10 to 40% of a nonionic synthetic organic detergent which is a polyethoxylated higher alkanol wherein the alkanol is of 10 to 18 carbon atoms and which contains from 3 to 12 ethylene oxide groups per mol, 3 to 15% of a water soluble synthetic organic anionic detergent selected from the group consisting of polyethoxy higher alkanol sulfates wherein the alkanol is of 10 to 18 carbon atoms and wherein from 2 to 8 ethylene oxide groups are present per mol and higher linear alkyl benzene sulfonates wherein the higher alkyl is of 10 to 15 carbon atoms, and mixtures thereof, 4 to 10% of a lower alkanol of 2 to 3 carbon atoms or a mixture of such alkanols, 2 to 12% of a mixture of sodium chloride and sodium nitrate, wherein the proportion of sodium chloride to sodium nitrate is in the range of 1:3 to 3:1 and 13 to 81% of water. Also within the invention are aqueous dilutions of such liquid detergent with one part of the detergent being diluted with from 0.1 to 2 parts of water. In a preferred embodiment of the invention the polyethoxylated higher linear alkanol is of an average of 12 to 13 carbon atoms, contains about 6.5 mols of ethylene oxide per mol and constitutes from 30 to 40% of the detergent, the anionic detergent is sodium linear dodecyl benzene sulfonate and is 5 to 10% of the product, the lower alkanol is ethanol and is 4 to 10% of the product, the mixture of sodium chloride and sodium nitrate is of a ratio of $NaCl:NaNO_3$ in the 1:1.5 to 1.5:1 range and is 2 to 6% of the composition and the water content is from 34 to 59%. In more preferred embodiments of the invention the polyethoxylated higher linear alkanol will be about 34% of the composition, the sodium linear dodecyl benzene sulfonate will be about 8.5%, the alcohol will be 6 to 8% and the sodium chloride - sodium nitrate mixture will be about 4%, with the ratio of sodium chloride to sodium nitrate being about 1:1, and substantially the balance of the composition will be water, preferably deionized, to produce a liquid detergent having a viscosity at 24° C. of about 75 to 90 centipoises.

The nonionic synthetic organic detergents employed in the practice of the invention are members of a relatively limited group, polyethoxylated higher alkanols, preferably polyethoxylated linear alkanols, although some other poly-lower alkoxylates, wherein the lower alkoxy is a mixture of ethoxy and propoxy, may be used. In such compounds the alkanol is of 10 to 18 carbon atoms, perferably of 12 to 15 carbon atoms and more preferably, in many cases, of 12 to 13 carbon atoms. The ethylene oxide content of such preferred nonionic detergents will generally be within the range of 3 to 12 ethylene oxide groups (no propylene oxides being present) per mol, preferably being 5 to 9 and more preferably 6 to 7, with 6.5 (when the higher alcohol is of an average of 12 to 13 carbon atoms) being most preferred, especially when employed together with a lesser proportion of sodium linear higher alkyl benzene sulfonate anionic detergent. Exemplary of compounds that are useful in the practice of the present invention are the commercial products manufactured by Shell Chemical Company, Inc., Neodol 23-6.5 and Neodol 25-7. The former is a condensation product of a mixture of higher fatty alcohols averaging about 12 to 13 carbon atoms with about 6.5 mols of ethylene oxide and the latter is a corresponding condensation product wherein the carbon atom content of the higher fatty alcohol averages about 12 to 15 and the number of ethylene oxide groups present is about 7. The higher alkanols are preferably primary monohydric alkanols, although other linear alkanols may also be employed, preferably with the hydroxyl thereof near the terminus of the linear alcohol, normally at the second, third or fourth carbon atom from the end. Other examples of useful nonionic detergents of this general type include Tergitol 15-S-7 and Tergitol 15-S-9, both of which are linear secondary alcohol ethoxylates made by Union Carbide Corporation. The former is a mixed ethoxylation product of a secondary alcohol of 11 to 15 carbon atoms with about 7 mols of ethylene oxide and the latter is a similar product but with 9 mols of ethylene oxide being reacted. Also useful in the present liquid detergent compositions as a nonionic detergent component, either alone or preferably in mixture with one of the Neodols previously described, are higher molecular weight materials such as Neodol 45-11, which are similar to the Neodols previously discussed but with the higher fatty alcohol thereof being of 14 to 15 carbon atoms and the number of ethylene oxide groups per mol averaging about 11. Other useful nonionics that may sometimes be employed are made by the substitution of a mixture of ethylene and propylene oxides (more ethylene oxide than propylene oxide) for the ethylene oxide in the condensation reaction, a representative of which group is Plurafac B-26 (BASF Chemical Company).

In the preferred poly-lower alkoxylated higher alkanol, to obtain the best balance of hydrophilic and lipophilic moieties the number of lower alkoxies, preferably all ethoxy, will usually be from about 40% to 80% of the number of carbon atoms in the higher alcohol, preferably 40 to 60% thereof and if any other nonionic detergents are present they will preferably constitute only a minor proportion of the total nonionic detergent content of the liquid detergent, preferably being less than 20% and more preferably less than 10% thereof. Condensation products of poly-lower alkylene oxides and alkanols of higher molecular weight than those described herein (over 18 carbon atoms per alkanol) may be contributory to gelation of the liquid detergent and consequently will preferably be omitted or limited in quantity in the present composition. In this respect, it is also most desirable to omit using condensation products wherein the higher alkanol on which they are based is of an average of more than 15 carbon atoms, although minor proportions of such materials may sometimes be employed for specific cleaning properties and other characteristics. The alkyl groups of the nonionic detergents will most preferably be linear, as previously mentioned, although a minor degree of slight branching may be tolerated, such as at a carbon next to or two carbons removed from the terminal carbon of the straight chain and away from the ethoxy chain, if such branched alkyl is no more than three carbons in length. Normally the proportions of carbon atoms in this type of a branched configuration will be minor, rarely exceeding 20% of the total carbon atoms content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 20% but, as in the cases of the mentioned Tergitols, may be greater.

When greater proportions of non-terminally alkoxylated alkanols, propylene oxide-containing poly-lower alkoxylated alkanols and less hydrophile-lipophile balanced nonionic detergents than mentioned above are employed and when other nonionic detergents are used instead of the preferred nonionics recited herein, the product resulting may not have as good detergency, stability, viscosity and non-gelling properties as the preferred compositions but use of the viscosity controlling compounds of the invention can also improve the properties of the detergents based on such nonionics. In some cases, as when a higher molecular weight poly-lower alkoxylated higher alkanol is employed, often for its detergency, the proportion thereof will be regulated or limited, as in accordance with the results of various experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation or separation at low temperatures.

With the nonionic detergent, which is the major synthetic organic detergent of the present phosphorus-free (and essentially nitrogen-containing builder-free) liquid detergent compositions, there is employed an anionic detergent, preferably a sulfated ethoxylated higher fatty alcohol of the formula $RO(C_2H_4O)_mSO_3M$, wherein R is a fatty alkyl of from 10 to 18 or 20 carbon atoms, $m$ is from 2 to 6 or 8 (preferably being from one-fifth to one-third or one-half the number of carbon atoms in R) and M is a solubilizing salt-forming cation, such as an alkali metal, ammonium, lower alkylamino or lower alkanolamino, or a higher alkyl benzene sulfonate wherein the higher alkyl is of 10 to 15 carbon atoms and the salt-forming ion on the sulfonic acid group is as described in M, above.

As is the case with the preferred nonionic detergents, the present poly-lower alkoxy higher alkanol sulfates are readily biodegradable and of better detergency when the fatty alkyl is terminally joined to the poly-lower oxyalkylene chain, which is terminally joined to the sulfate. Again, as in the case of the nonionic detergents, a small proportion, for example, not more than 10%, of branching and medial joinder are tolerable. Generally, it will be preferred for the alkyl in the anionic alkoxylate detergent, as in the nonionic detergent, to be a mixture of different chain lengths, as 12, 13, 14 and 15 carbon atom or 12 and 13 carbon atom chains, rather than all of one chain length. Nevertheless, the invention is applicable to liquid detergents containing pure nonionic and anionic components.

Of course, ethylene oxide is the preferred lower alkylene oxide of the anionic alkoxylate detergent, as it is for the nonionic detergent, and the proportion thereof in the sulfated poly-ethoxylated higher alkanol is preferably 2 to 5 mols of ethylene oxide groups present per mol of anionic detergent and in more preferred compositions from 2 to 4 mols will be present, with three mols being most preferred, especially when the higher alkanol is of 12 to 13 carbon atoms or 12 to 15 carbon atoms. To maintain the desired hydrophile-lipophile balance, when the carbon atom content of the alkyl chain is in the lowest portion of the 10 to 18 carbon atom range the ethylene oxide content of the detergent may be reduced to about two mols per mol whereas when the higher alkanol is of 16 to 18 carbon atoms, in the higher part of the range, the number of ethylene oxide groups may be increased to 4 or 5 and in some cases to as high as 8. Similarly, the salt-forming cation may be altered to obtain the best solubility. It may be any suitable solubilizing metal or radical but will most frequently be alkali metal, e.g., sodium, or ammonium. If lower alkylamine or alkanolamine groups are utilized the alkyl and alkanols thereof will usually contain from 1 to 4 carbon atoms and the amines and alkanolamines may be mono-, di- or tri-substituted, as in monoethanolamine, diisopropanolamine and trimethylamine.

A preferred polyethoxylated alcohol sulfate detergent is available from Shell Chemical Company and is marketed as Neodol 25-3S. This material, the sodium salt, is normally sold as a 60% active ingredient product and includes about 40% of aqueous solvent medium, of which a minor proportion is ethanol. In the formulations given Neodol 25-3S will be considered as 100% active material and the water and alcohol contents thereof will be separately listed as liquid detergent components. Although Neodol 25-3S is the sodium salt, the potassium salt and other suitable soluble salts of the triethenoxy higher alcohol (12 to 15 carbon atoms) sulfate and other compounds herein described, such as have already been referred to, may also be used in partial or complete substitution for the sodium salts. As with the various materials of the present compositions, mixtures thereof may be utilized.

Examples of the higher alcohol polyethenoxy sulfates which may be employed as the anionic detergent constituent of the present liquid detergents or as partial substitutes for this include: mixed $C_{12-15}$ normal or primary alkyl triethenoxy sulfate, sodium salt; myristyl triethenoxy sulfate, potassium salt; n-decyl diethenoxy sulfate, diethanolamine salt; lauryl diethenoxy sulfate, ammonium salt; palmityl tetraethenoxy sulfate, sodium salt; mixed $C_{14-15}$ normal primary alkyl mixed tri- and tetraethenoxy sulfate, sodium salt; stearyl pentaethenoxy sulfate, trimethylamine salt; and mixed $C_{10-18}$ normal primary alkyl tri-ethenoxy sulfate, potassium salt. Minor proportions of the corresponding branched chain and medially alkoxylated detergents, such as those described above but modified to have the ethoxylation at a medial carbon atom, e.g., one located four carbons from the end of the chain, may be employed and the carbon atom content of the higher alkyl will be the same. Similarly, the joinder to the normal alkyl may be at a secondary carbon one or two carbon atoms removed from the end of the chain. In either case, as previously indicated, only minor proportions should be present, such as 10 or 20%, in the usual case. Instead of the polyethoxylated higher alkanol sulfates higher (10 to 18 or 20 carbon atoms) alkyl benzene sulfonate salts wherein the alkyl group preferably contains 10 to 15 carbon atoms, most preferably being a straight chain alkyl radical of 12 or 13 carbon atoms, may also be used to make excellent liquid detergents based primarily on the mentioned nonionic detergents. Preferably, such an alkyl benzene sulfonate has a substantial content of 3- (or higher) phenyl isomers and a correspondingly lower content (usually well below 50%) of 2- (or lower) phenyl isomers; in other words, the benzene ring is preferably attached in large part at the 3, 4, 5, 6 or 7 position of the alkyl group and the content of isomers in which the benzene ring is attached at the 1 or 2 position is correspondingly low. Typical such alkyl benzene sulfonates are described in U.S. Pat. No. 3,340,174. Of course, more highly branched alkyl benzene sulfonates may also be employed but usually are not preferred, due to their biostability (lack of biodegradability).

Other anionic detergents, such as those described in our co-pending application Ser. No. 511,760, filed Oct. 1, 1974, hereby incorporated by reference, may also be employed but normally these will be only minor proportions of the total anionic detergent content of the present liquid detergents, usually being less than 20% thereof and preferably less than 10% thereof. Similarly, amphoteric detergents may be employed instead of all or some of these other anionics and such materials are described in our mentioned patent application, too. Other nonionic detergents, such as described therein, may be utilized in partial replacement of the preferred nonionic detergents but proportions of such other nonionics will also generally be minor, normally being less than 10% of the total nonionic detergent content.

The lower alkanol utilized, which functions in various capacities, principally as a solvent and anti-gelling agent, while it may be of 1 to 4 carbon atoms, is very preferably of 2 to 3 carbon atoms and most preferably is ethanol, although a mixture of ethanol and isopropanol may be substituted in many cases. In mixtures of ethanol and isopropanol the isopropanol may be a major component but preferably the ethanol is, usually being at least 60% and preferably at least 75% of the alkanol content. The mixture of inorganic salts is a mixture of at least one chloride and at least one nitrate, such as the alkali metal salts thereof, and very preferably is a mixture of sodium chloride and sodium nitrate. Such a mixture, in the proportions given, satisfactorily regulates the viscosity of the described liquid detergents, holding them in the desired range and helps to prevent low temperature separations, solidifications, gelations, thickenings and in some cases, thinnings of the liquids.

Water for formulating the present liquid detergents may come from the starting materials themselves, such as solutions or suspensions of the anionic detergent salts, or may be added. When added it will be preferable to utilize deionized water or water of low hardness, e.g., under 50 p.p.m. of calcium, magnesium and iron hardness salts, as calcium carbonate, preferably under 10 p.p.m. However, while it is undesirable to utilize hard waters, this may be done and satisfactory products may be made from waters of hardnesses as high as 200 p.p.m. but generally the use of such water is avoided where possible.

To assist in solubilizing the detergents and the optical brighteners and other ingredients which may be present in the liquid detergents a small proportion of alkaline material or a mixture of such materials is often included in the present formulations. Suitable alkaline materials include mono-, di- and trialkanolamines, alkyl amines, ammonium hydroxide and alkali metal hydroxides. Of these, the preferred materials are the alkanolamines, preferably the tri-alkanolamines and of these triethanolamine is especially preferred. The pH of the final liquid detergent, containing such a basic material will usually be neutral or slightly basic. Satisfactory pH ranges are from 7 to 10, preferably about 7.5 to 9.5 but because a pH reading of the liquid detergent, using a glass electrode and a reference calomel electrode, may be inaccurate, due to the detergent system often being largely non-aqueous, a better indication is obtained by measuring the pH of a 1% solution of the liquid detergent in water. Such a pH will also normally be in the range of about 7 to 10, preferably 7.5 to 9.5. In the wash water the pH will usually be in this range or might be slightly more acidic, as by 0.5 to 1 pH unit, due to the normal acid content of soiled laundry.

The optical fluorescent brighteners or whiteners which may be employed in the liquid detergent are important functional constituents of modern detergents which give washed laundry and materials a bright appearance so that the laundry is not only clean but also looks clean. Due to the variety of synthetic fibers incorporated in the textiles which are made into clothing and other items of laundry and the importance of substantivity of the brightener compound to the fibers, many different optical brightening compounds have been made, which may be incorporated in the present detergent compositions, often in mixtures. Although it is possible to utilize a single brightener for a specific intended purpose in the present liquid detergents it is generally desirable to employ mixtures of brighteners which will have good brightening effects on cotton, nylons, polyesters and blends of such materials and which are also bleach stable. A good description of such types of optical brighteners is given in the article *Optical Brighteners and Their Evaluation* by Per S. Stensby, a reprint of articles published in *Soap and Chemical Specialties* in April, May, July, August and September, 1967, especially at pages 3–5 thereof. That article and U.S. Pat. 3,812,041, of one of the present inventors, issued May 21, 1974, both of which are hereby incorporated by reference for their relevant disclosures, contain detailed descriptions of a wide variety of suitable optical brighteners. Accordingly, only a very brief description of these materials will be given here.

The cotton brighteners, frequently referred to as CC/DAS brighteners because of their derivation from the reaction product of cyanuric chloride and the disodium salt of diaminostilbene disulfonic acid in a molar proportion of 1:2, are bistriazinyl derivatives of 4,4′-diaminostilbene-2,2′-disulfonic acid. Bleach stable brighteners are usually benzidine sulfone disulfonic acids, naphthatriazolylstilbene sulfonic acids or benzimidazolyl derivatives. The polyamide brighteners, especially good for nylons, are usually either aminocoumarins or diphenyl pyrazoline derivatives. Additionally, there are polyester brighteners, which also serve to whiten polyamides. The brighteners are used in their acid forms or as salts in the present liquid detergent compositions and in the wash waters resulting from use of the liquid detergents the brighteners are maintained sufficiently soluble so as to be effective and uniformly substantive to the materials of the laundry being washed, due to the presence in the detergents of the detergent components, especially the nonionic detergent, the alkanol and the basic material.

Among the brighteners that are used in the present systems are: Calcofluor 5BM (American Cyanamid); Calcofluor White ALF (American Cyanamid); SOF A-2001 (CIBA); CDW (Hilton-Davis); Phorwite RKH, Phorwite BBH and Phorwite BHC (Verona); CSL, powder, acid (American Cyanamid); FB 766 (Verona); Blancophor PD (GAF); UNPA (Geigy); Tinopal CBS and Tinopal RBS 200 (Geigy). The acid or "nonionic" forms of the brighteners tend to be solubilized by alcohols of the present formulas, while the salts tend to be water soluble. Thus, a combination of such solvents and the detergent combination serves to keep the fluorescent brighteners dissolved.

Adjuvants may be present in the liquid detergent to give it additional properties, either functional or aesthetic. Thus, soil suspending or anti-redeposition agents may be used, such as sodium carboxymethyl cellulose, polyvinyl alcohol, hydroxypropylmethyl cellulose; enzymes, e.g., protease, amylase; thickeners, e.g., gums, alginates, agar agar; hydrotropes, e.g., sodium xylene sulfonate, ammonium benzene sulfonate; foam improvers, e.g., lauric myristic diethanolamide; foam destroyers, e.g., silicones; bactericides, e.g., tribromosalicylanilide, hexachlorophene; fungicides; dyes; pigments (water dispersible); preservatives; ultraviolet absorbers; fabric softeners; pearlescing agents; opacifying agents, e.g., behenic acid, polystyrene suspensions; and perfumes. Of course, such materials will be selected for the properties desired in the finished product and to be compatible with the other constituents thereof. Among the adjuvants that may be employed are dihydric or trihydric lower alcohols which, in addition to having solubilizing powers and reducing the flash point of the product, also can act as antifreezing constituents and may improve compatibilities of the solvent system with particular product components. Among these compounds the most preferred group includes the lower polyols of 2 to 3 carbon atoms, e.g., ethylene glycol, propylene glycol and glycerol, but the lower alkyl ($C_1$–$C_4$) etheric derivatives of such compounds, known as Cellosolves, may also be employed. The proportions of such substitutes for the lower alkanols will be limited, normally being held to no more than 20% of the total alcohol content of the liquid detergent.

The proportions of the various components of the present heavy duty liquid detergents are important for the manufacture of a uniform product of desirable viscosity and acceptable heavy duty laundering action which does not gel at low temperatures or upon standing in an open container at room temperature. So as to promote solubility of the fluorescent brighteners and other constituents of the liquid detergent which may be present and to make a clear, homogeneous and readily pourable liquid product, from 10 to 40% (sometimes as much as 50% may be tolerated) of the total liquid detergent should be nonionic detergent of the higher fatty alkanol - ethylene oxide condensation product type described and it is preferred that this percentage be from 20 to 40%, more preferably 30 to 40% and most preferably about 34%. The proportion of anionic detergent, such as polyethoxy higher linear alkanol sulfate, will usually be in the range of 3 to 15%, preferably 4 to 12% more preferably 5 to 10% and most preferably about 8.5%. The ratio of the nonionic detergent to th anionic detergent (or ratios of totals of such materials) will normally be from 8:1 to 2:1, preferably being 5:1 to 3:1 and most preferably about 4:1.

The lower alcohol in the liquid detergent, preferably ethanol, will generally be present in a sufficient proportion to aid in dissolving and/or stabilizing the various constituents in the final product but in the most preferred embodiments of the invention the proportion of alcohol used will be such that without the viscosity control agent (salt mixture) present the liquid detergent would be of undesirable viscosity, normally being too viscous, would gel in the bottle upon storage or after a short exposure to air at room temperature, would not be fluid at lower temperatures, such as 7° C. and/or would separate at such temperaatures. The content of alcohol employed, together with the chloride-nitrate mixture, avoids such undesirable effects. The use of the mixture of sodium chloride and sodium nitrate allows a reduction in the quantity of alcohol required in these formulations to give the desired viscosity and in this respect the present invention is a significant improvement over that described in U.S. Pat. No. 3,812,041, which discloses the employment of lower alkanol as a solvent in a liquid detergent.

The proportion of lower alkanol used will normally be frm 4 to 10%, preferably 6 to 10%, more preferably 6 to 8% and most preferably about 6 or 8%, depending on the types and amounts of nonionic and anionic detergents in the liquid detergent and the viscosity desired. Although the alcohol levels mentioned are not so high as to prevent freezing at very low temperatures the product will thaw to a pourable homogeneous liquid and is pourable at 7° C., which is considered to be the lowest temperature normally encountered under reasonable shipping and storage conditions.

The combination of nitrate and chloride salt viscosity control agents will normally be from 2 to 12% or 2 to 10% of the detergent, preferably 2 to 6%, more preferably 3 to 5% and most preferably about 4%. The ratio of the chloride to the nitrate, e.g., NaCl 3, will usually be in the range of 1:3 to 3:1, preferably 1:2 to 2:1, more preferably 1:1.5 to 1.5:1 and most preferably about 1:1. When such quantities of the viscosity control agent mixture are employed it has been found that the percentage of alcohol needed in the product to maintain its desirable characteristics, as previously described, may be reduced by up to 6%, usually by 1 to 6%, e.g., 2%, 3% and 5%. Such savings of ethanol, which is difficult to obtain and is comparatively expensive at this time, allows the marketing of almost 50% more of this detergent product than would be the case were the viscosity control agent not used and were reliance for viscosity control, etc., placed entirely on the incorporation of the lower alcohol in the liquid detergent. Thus the present detergents represent a significant discovery because the savings in alcohol for one manufacturer alone can amount to hundreds of thousands of gallons or over a million liters per year and can therefore allow the maintenance of nationwide marketings of liquid detergent products by a manufacturer and can avoid the difficulties encountered when the alcohol normally needed for controlling viscosity in such a product is in short supply or the otherwise needed quantity is unavailable. For example, it has been calculated that by the use of 2% of sodium chloride and 2% of sodium nitrate in the present liquid detergent formulas the content of SD-40 alcohol in the detergent formula may be dimished to such an extent that there would be saved about 50,000 to 170,000 gallons (about 200,000 to 650,000 liters) of alcohol per million cases of liquid detergent (with each case containing about 3 gallons, about 11.5 liters, of liquid detergent).

The percentage of the mixture of viscosity control salts will normally be from 5 to 20%, preferably 7 to 17% of the total detergent content of the liquid detergent, including both nonionic and anionic detergents.

The percentage of water, the main solvent in the present compositions (excluding the nonionic detergent component), will usually be from 13 to 81%, preferably being 32 to 70%, more preferably 34 to 59% for those formulas in which the anionic detergent is sodium linear dodecyl benzene sulfonate and more preferably being 30 to 49% for those detergents in which the anionic detergent component is polyethoxy alkanol sulfate. In the most preferred formulations the water content will be in the range frm about 40.2 to 46.5%. Such quantities may be modified, with the proportion of water being diminished, when the detergent has various adjuvants present, with the adjuvants normally replacing a corresponding amount of water.

The content of basic additive or alkalizing agent, such as triethanolamine, will usually be from 0.1 to 5% of the detergent, preferably 0.5 to 3% thereof. The total proportion of optical brightener, usually a mixture of brighteners, will normally be from 0.05 to 1.5%, preferably 0.1 to 1% and most preferably 0.5 to 1%.

In view of the different types of adjuvants which may be present in the liquid detergents, useful for widely different purposes, the proportions thereof employed may vary greatly. Generally however, the total proportion of adjuvants, including the pH adjusting adjuvants and optical brighteners previously mentioned, will not exceed 10%, preferably will be less than 5% and more preferably less than 3%, with individual components not exceeding 5%, preferably 3% and more preferably being not more than 2% of the product. The use of greater proportions of the adjuvants can significantly change the properties of the liquid detergent and therefore, is to be avoided.

The liquid detergents described herein are in concentrated form and may contain as much as about 50% of synthetic organic detergent constituents. Therefore, such detergents may be diluted, usually with water, so as to produce weaker products which are yet sufficiently effective for many uses other than the heaviest duty type of laundering or could be used for heavy duty applications if enough would be employed. Some such diluted products will also tend to have undesirable viscosities, outside the normally useful range of 40 to 120 centipoises at 24° C., may be solidified or gelled at tempertures as low as 7° C. and can form objectionable skins thereon when exposed to air, if the viscosity control agent is omitted. Such products can be benefited by the presence therein of the proportions of solvent and anti-gelling agent salt mixture found in the more concentrated detergents. Accordingly, it is contemplated that the present liquid detergents may be diluted with from 0.1 to 2 parts of water and in such dilutions the sodium chloride-sodium nitrate mixture is beneficial.

The liquid detergents of the present invention, can be made by simple manufacturing techniques which do not require any complicated equipment or expensive operations. In a typical manufacturing method the optical brighteners may be slurried in the monohydric alcohol, after which water is added to the slurry, together with a small amount of a base, such as triethanolamine, which helps to partially dissolve the previously suspended material but does not usually yield a clear solution. Addition of the detergent combination usually results in the remainder of the brightener dissolving to make a clear solution. Then the viscosity control salt mixture is added and agitation is continued until the solution becomes clarified, which may normally take about 5 to 10 minutes. At this point other adjuvants may be added, followed by perfume and dye to give the product its final desired properties, including appearance and aroma. If desired the viscosity control additive may be incorporated earlier in the procedure. All of the above operations may be effected at room temperature, although suitable temperatures within the range of 20° to 50° C. may be employed, as desired, with the proviso that when volatile materials, such as perfume, are added, the temperature should be low enough so as to avoid objectionable losses. Additions of the various adjuvants may be effected at suitable points in the process but for the most part these will be added to the final product or near the end of the process. The product obtained will usually have a pH within the range of 7 to 10, e.g., 7.5, and a density within the range of from 0.9 to 1.1, preferably from 0.95 to 1.05. The viscosity of the product at 24° C. will be in the range of 40 to 120 centipoises, preferably from 70 to 115 centipoises, more preferably 75 to 110 centipoises, most preferably for the liquid detergents based on higher alkyl benzene sulfonate as the anionic detergent component, from 75 to 90 or 95 centipoises. The viscosity measures are made at 24° C., using a Brookfield viscosimeter, Model LV, No. 1 spindle, at 12 revolutions per minute.

Use of the present compositions is very easy and efficient. Compared to heavy duty laundry detergent powders, much smaller volumes of the present liquids may be employed to obtain cleaning of soiled laundry. For example, using a typical formulation of this invention, containing about 34% of the fatty alcohol - ethylene oxide condensate nonionic detergent and 8.5% of the alkoxylated alcohol sulfate anionic detergent or alkyl benzene sulfonate detergent, only about 60 grams or one-fourth cup of liquid need to be used for a full tub of wash in a top-loading automatic washing machine in which the water volume is 15 to 18 gallons (55 to 75 liters) and even less (about one-half) is needed for front-loading machines. Thus, the concentration of liquid detergent in the wash water is only on the order of 0.1%. Usually, the proportion of liquid detergent will be from 0.05 to 0.3%, preferably 0.08 to 0.2% and more preferably about 0.08 to 0.15%. The proportions of the various active detersive constituents of the liquid detergent, based on the examples to be given, may be varied with respect to the solvents in which case the amount of liquid detergent used per wash will be changed accordingly. Equivalent results can be obtained by using greater proportions of a more dilute liquid detergent but the greater quantity needed will require additional packaging and shipping space and will be less convenient for the consumer to use.

Although it is preferred to employ wash water of reasonably low hardness at an elevated temperature, the present liquid detergents are also useful in laundering clothes and other items in hard waters and in extremely soft waters at room temperature and lower. Thus, water hardnesses may range from 0 to over 300 parts per million as calcium carbonate and washing temperatures may be from 10° C. to 80° C. Preferably the water temperature will be from room temperature (20° to 25° C.) 70° C. In American laundering practice it is typically found that the wash water, if considered to be hot, is at a temperature of about 50° C. and if considered to be cold is at 10 to 20° C. Preferably, the water used will have a hardness of 50 to 150 p.p.m. and will usually contain a mixture of magnesium and calcium hardness ions, with the calcium hardness being a major proportion thereof. Although washing will most often be effected in an automatic washing machine, of either the top or side loading type, followed by rinse, spin, draining and/or wringing operations, the detergent may also be used for hand washing laundry. In such cases the concentration in the wash water of the liquid detergent will often be increased and sometimes it may be employed full strength to assist in washing out otherwise difficult to remove soils or stains. After completion of the normal washing and spinning operations it will be a general practice to dry the laundry in an automatic dryer soon afterward but other modes of drying may also be utilized.

The compositions of this invention will now be more fully illustrated by the following specific examples thereof, which are intended to be illustrative and in no way limitative. Unless otherwise indicated, all parts and percentages are by weight and temperatures are in ° C.

EXAMPLE 1

| | % |
|---|---|
| $R'O(C_2H_4O)_{6.5}H$ (Neodol 23–6.5, R' = mixed higher alkyls, averaging 12 to 13 carbon atoms) | 34.0 |
| Sodium linear dodecyl benzene sulfonate | 8.5 |
| SD-40 denatured alcohol | 8.0 |
| Sodium chloride | 2.0 |
| Sodium nitrate | 2.0 |
| Triethanolamine | 1.3 |
| Optical brightener mixture | 0.8 |
| Color solution (1.5% solids, 98.5% water) | 1.0 |
| Perfume | 0.4 |
| Deionized water | 42.0 |
| | 100.0 |

A clear liquid detergent of the above formula is prepared at room temperature by slurrying the mixture of optical brighteners in the SD-40 alcohol, followed by the addition of water and triethanolamine with stirring, after which the Neodol 23–6.5 and sodium dodecyl benzene sulfonate are added. After a few minutes of agitation at moderate speed (seven minutes at 100 revolutions per minute stirrer speed) the room temperature solution becomes clear. Then there are added to it the sodium chloride, sodium nitrate, color solution and perfume, after preliminary dissolving of the sodium chloride and sodium nitrate in a portion of the water (usually about one-fourth to one-half of the water added.

The viscosity of the liquid detergent is measured at room temperature (24° C.) and is found to be 76 centipoises. The viscosity is measured with a No. 1 spindle of a Brookfield viscosimeter, Model LV, with the spindle rotating at 12 r.p.m. The density of the detergent is about 1.01 g./ml. at 25° C. and its pH is about 9.0. The physical appearance of the liquid detergent is observed after standing for one hour at room temperature in an open beaker. No skin or gel is noted on the surface. When such a test is continually repeated, with the test liquid being returned to a bottle between testings, still no gelation or skin formation takes place. The temperature of the liquid detergent is lowered to 7° C. and is maintained there for at least two weeks, after which, when tested for pourability, it is found that the product is fluid and satisfactorily pourable at such temperature and at room temperature, to which it is subsequently returned.

A top loading automatic washing machine is loaded with 3.6 kilograms of mixed soiled laundry and is filled with 70 liters of water at 50° C. Sixty grams of the liquid detergent are added to the washing machine tub and a normal wash cycle is initiated. After completion of the washing and accompanying rinsing, which takes 45 minutes, and drying, the clothing is examined and is compared with a control mixed wash washed by a commercial type detergent containing 30% of pentasodium tripolyphosphate and 12.5% of sodium dodecyl benzene sulfonate. The washings of the laundry are found to be essentially equivalent or in favor of the experimental formula. This also the case after several launderings of the same materials, which are repeatedly soiled between washings, and when washings are effected at lower temperatures, e.g., 10°, 20° and 30° C. Especially good cleaning results are observed on colors and cuffs, to the dirty sections of which the concentrated liquid detergent is initially applied before washing. The presence of the viscosity controlling salt mixture helps the detergent to penetrate between the fibers and thereby assists in loosening the soil from the items being laundered.

When the visocisty control salt mixture is omitted from the formulation, being replaced by a like quantity of water, the product is a solid at room temperature and at 7° C.

When the Neodol 23-6.5 is replaced by Neodol 25-7, $RO(C_2H_4O)_7H$, wherein R equals mixed 12, 13, 14 and 15 carbon atoms alkyl, with no other changes in the formulation, the viscosity at 24° C. is 95 centipoises and the detergent product is fluid at 7° C. after 24 hours standing at that temperature. It does not form a skin on the surface thereof on standing at room temperature in an open container, according to the test described in the foregoing specification. However, when the mixture of sodium chloride and sodium nitrate is omitted, being replaced by a like quantity of water, the detergent is a solid at both room temperature and such lower temperature.

When the formula given is modified by decreasing the alcohol content to 6% and increasing the water content accordingly, the product has a viscosity at 24° C. of 90 centipoises, is fluid at lower temperatures and does not form an objectionable skin on exposure to air. Similarly, when the alcohol content is increased to 10%, with the water content being lowered accordingly, the viscosity is lowered to about 60 centipoises, the product is still fluid at lower temperatures and does not form objectionable surface film in normal use. Additional changes in ethanol contents to 4 and 5%, with water contents being increased accordingly, cause an increase in viscosity to about 105 and 120 centipoises, respectively, but the product is still satisfactorily fluid and non-film forming.

When the above experiments are repeated, substituting isopropanol for ethanol, similar results are obtained but it is preferred, for best product odor, when isopropanol is employed, that it be used mixed with ethanol, with ethanol as the major lower alkanol present. Thus, in embodiments of liquid detergents containing such mixed alcohols, when the previously reported experiments are modified to utilize corresponding percentages of an ethanol-isopropanol mixture wherein the ratios of ethanol to isopropanol are 1:4 and 9:1, similar thinning, viscosity controlling, room and low temperature properties and non-filming properties are obtained.

In all the above formulas omissions of the triethanolamine, color solution, brightener mixture and perfume have little effects on the properties described except that the pH is lowered, usually to about neutrality.

When, in the mentioned products, the ratio of sodium chloride to sodium nitrate is changed so as to be 1:3, 1:2, 1:1.5, 1.5:1, 2:1 and 3:1, good viscosity control within the mentioned 40 to 120 centipoise range at room temperature is obtained, the detergent is fluid at low temperatures and anti-filming effects result. However, the mixtures of viscosity controlling salts wherein the sodium chloride is present in greater proportion than sodium nitrate yield lower viscosities and those wherein the nitrate is present to a greater extent are less corrosive to metal parts with which the detergent may come in contact, e.g., brass plunbing fixtures. When the total percentages of the mixed salts present are varied, to be 2, 3, 6, 8 and 10%, acceptable viscosity control is obtained and the liquid detergents are fluid at low temperature. Also, they do not form objectionable skins on open surfaces. Generally, when less than 4% of the mixture is used the detergents are thicker but are still of acceptable viscosity and when more than 4% is used they are correspondingly thinned. Therefore, with the present formulation, based on alkyl benzene sulfonate as the anionic detergent and Neodol 23-6.5 as the nonionic detergent, it may be considered that thicker products should be produced and in such cases it may be that the use of more than 6% of the mixed salts would be avoided in the interest of maintaining the viscosity of the liquid detergent somewhat higher than would result if more of the "thinning" agent mixture was present.

Further changes made in the described formulas include replacing the mentioned Neodols with Plurafac B-26 and replacing 20% of the Neodols or the Plurafac with Neodol 45—11. Such products are also of acceptable viscosities when the present viscosity controlling salts are incorporated together with the described amounts of lower alcohol. In such formulas, instead of triethanolamine there are also employed equivalent proportions of other alkalizing agents, e.g., sodium hydroxide or sodium carbonate. Solubilizing of the fluorescent brightener, when present, thereby occurs and the pH of the product is held in the 8–9 range.

Other modifications of the formula include utilizing mixtures of Neodol 23-6.5 and 25-7, in approximately equal proportions, and mixtures of sodium dodecyl benzene sulfonate and Neodol 25-3S, also in approximately equal proportions. Further variations include employing Neodol 23-6.5 and sodium dodecyl benzene sulfonate, as in the basic formula given but in different proportions, with the formulas being in the following ratios, totalling, 20, 30, 35 and 42.5% in each case: (1), 1:1; (2) 2:1; (3) 3:1; (4) 4:1; and (5) 5:1. In such experiments, sodium, potassium, ammonium and triethanolamine salts of the anionic detergent(s) or mixtures of such salts are employed. The products made are of satisfactory pourability.

When the above-described liquid detergents are diluted with deionized water or tap water in ratios of detergent:water of 1:0.2, 1:0.5, 1:1 and 1:1.5, the products are liquid and although thinner, are of satisfactory viscosities, considering their lower detergent concentrations and the presences of the mixed salts in these formulas help to maintain the desired viscosities with the use of limited proportions of alcohol and help to prevent the development of undesirable storage properties. Also, the presence of the nitrate helps to inhibit corrosive tendencies of the chloride in such formulations.

EXAMPLE 2

| | % |
|---|---|
| $RO(C_2H_4O)_7H$ (Neodol 25-7, R = mixed primary alkyls of 12, 13, 14 and 15 carbon atoms) | 34.0 |
| $RO(C_2H_4O)_3SO_3Na$ (Neodol 25-3S, R = mixed primary alkyls of 12, 13, 14 and 15 carbon atoms) | 8.5 |
| SD-40 denatured alcohol | 10.0 |
| Sodium chloride | 3.0 |
| Sodium nitrate | 3.0 |
| Triethanolamine | 1.3 |
| Optical brightener mixture | 0.8 |
| Color solution (1.5% dye solids and 98.5% water) | 1.0 |
| Perfume | 0.4 |
| Deionized water | 38.0 |
| | 100.0 |

A controlled viscosity liquid detergent of the above formula is made according to the method described in Example 1, substituting the above nonionic and anionic detergents for those of Example 1. The product has a viscosity of about 100 centipoises at room temperature, is fluid at lower temperatures and does not form any skin on the surface thereof on standing in air. When the content of the mixed salts, in 1:1 ratio, is reduced to 4%, the viscosity is 110 centipoises at room temperature but the product sometimes becomes solid after standing for 24 hours at 7° C. and therefore is of lesser acceptability. In control experiments it is noted that when 4% of sodium chloride and no sodium nitrate is utilized the liquid detergent made is fluid at lower temperatures and has a viscosity of 85 centipoises at 24° C. but when 4% of sodium nitrate is substituted and no chloride is present the viscosity is outside the desired range, being 155 centipoises at 24° C. and the product is solid at lower temperatures. With 2% of sodium chloride being utilized and no nitrate the viscosity at 24° C. is 120 centipoises but the product solidifies on standing at 7° C. To make a product of the formula of this example with desired properties without using either the chloride or the nitrate or the viscosity controlling salt mixture one has to employ about 14% of ethanol to produce a product which has a viscosity at 24° C. of 75 centipoises and is fluid at 7° C.

From the above experiment and the "controls" described it will be evident that when using Neodol 25-7 and Neodol 25-3S in the proportions mentioned it is desirable to utilize at least 6% of the sodium chloride-sodium nitrate mixture. Thus, it is preferred to employ 2 to 6% of such mixture for the Neodol 23-6.5 -sodium dodecyl benzene sulfonate product (minimizing the salt content of the liquid) and from 6 to 10% of the mixture for a product of the type of this example to obtain best thinning, low temperature properties, anti-filming and anti-corrosion effects.

In modifications of the described experiments a mixture of Neodol 25-7 and 23-6.5 is utilized, as is a mixture of Neodol 25-3S and sodium linear dodecyl benzene sulfonate, in the proportions given in this example, with about equal parts of each of the nonionic detergents and equal parts of each of the anionic detergents. Employing 3% of each of sodium chloride and sodium nitrate acceptable products are produced. Similarly, Tergitol 15-S-7 and 15-S-9 are substituted separately or in equal mixture for the nonionic detergent and a satisfactory liquid product is made.

In other variations of the above experiments, proportions of the various components are modified plus 10%, plus 15%, minus 10% and minus 20% and good liquid detergents are produced. In all cases the detergents made are of satisfactory washing properties in the washing of mixed soiled laundry loads in automatic washing machines, as previously described. They also do not corrode the washing machine parts or brass parts of dispensing equipment which may be utilized. In addition to the sodium nitrate and sodium chloride, other alkali metal halides and nitrates, such as potassium salts, may be employed with similar effects. Also, as in Example 1, the various components of the detergent compositions and their proportions may be varied and useful viscosity control and detergency are obtained. Additionally, adjuvants such as hydrotropes, sesquestrants, bactericides, emollients, pearlescing agents and foaming agents may be present, usually at 0.1 to 1% concentrations.

In the described experiments it is apparent that the nitrate has a combination effect with the chloride to produce improved viscosity control of the product without excessive corrosion and helps to prevent low temperature solidification or gelation. These effects are especially apparent and useful in the described compositions based on Neodol 25-7, Neodol 23-6.5, Neodol 25-3S and sodium linear dodecyl benzene sulfonate, thinned with alcohol. Such results are obtainable over the described pH range of 7 to 10 and the pH may be adjusted within such range by utilization of more or less of the triethanolamine or other alkalizing agent.

In producing the present detergents it is generally desirable, after settling on a formula of a particular type for best detergency and other associated properties, to vary the proportions of lower alkanol and viscosity control agent mixture, measure the viscosities at 24° C. note the conditon of the product after 24 hours standing at 7° C. and observe for filming tendencies. Then, plots are made and product formulations are adjusted accordingly to produce the desired room temperature viscosity, low temperature anti-gelling properties and no filming most economically, with the greatest saving of alkanol and use of as little salt mixture as is needed. Thus, the present invention lends itself to use, with the benefit of such charts, for desirably and controllably adjusting the viscosities and anti-gelling properties of various formulations of liquid detergents of these types.

Other anti-gelling or viscosity controlling additives, such as are described in our previous patent application Ser. No. 511,760 may also be included with the nitrate-chloride mixtures, usually to the extent of no more than about 1–4%, for their additive or combination effects. However, their use is not necessary in the present compositions.

The invention has been described with respect to working examples and illustrations thereof but is not to be limited to these because it is evident that one of skill in the art with access to the present specification will be able to employ substitutes and equivalents without departing from the spirit or scope of the invention.

What is claimed is:

1. A liquid detergent comprising from 10 to 40% of a nonionic synthetic organic detergent which is a polyethoxylated higher alkanol wherein the alkanol is of 10 to 18 carbon atoms and which contains from 3 to 12 ethylene oxide groups per mol, and 3 to 15% of a water soluble synthetic organic anionic detergent selected from the group consisting of polyethoxy higher alkanol sulfates wherein the alkanol is of 10 to 18 carbon atoms and wherein from 2 to 8 ethylene oxide groups are present per mol and higher linear alkyl benzene sulfonates wherein the higher alkyl is of 10 to 15 carbon atoms, and mixtures thereof, 4 to 10% of a lower alkanol of 2 to 3 carbon atoms or a mixture of such alkanols, 2 to 12% of a mixture of sodium chloride and sodium nitrate, wherein the proportion of sodium chloride to sodium nitrate is in the range of 1:3 to 3:1 and about 13 to 81% of water, which is of a viscosity in the range of 40 to 120 centipoises at 24° C. and which is fluid at 7° C.

2. A liquid detergent according to claim 1 which has a viscosity in the range of 70 to 115 centipoises at 24° C. and which comprises from 20 to 40% of polyethoxylated higher alkanol wherein the alkanol is linear and of 12 to 15 carbon atoms and contains from 5 to 9 ethylene oxide groups per mol, 4 to 12% of water soluble synthetic organic anionic detergent which is selected from the group consisting of polyethoxy higher alkanol sulfates wherein the alkanol is linear and of 12 to 15 carbon atoms and contains from 2 to 5 ethylene oxide groups per mol and higher linear alkyl benzene sulfonates wherein the higher alkyl is of 11 to 13 carbon atoms, and mixtures thereof, 4 to 10% of lower alkanol which is ethanol or a mixture of ethanol and isopropanol, in which mixture the ethanol is present in a major proportion, 2 to 10% of a mixture of sodium chloride and sodium nitrate in which the ratio thereof is from 1:2 to 2:1 and about 32 to 70% of water.

3. A liquid detergent according to claim 2 which has a viscosity in the range of 75 to 110 centipoises at 24° C. and which comprises from 30 to 40% of polyethoxylated higher linear alkanol of 12 to 15 carbon atoms and 6 to 7 ethylene oxide groups per mol, 5 to 10% of water soluble synthetic organic anionic detergent which is selected from the group consisting of sodium polyethoxy higher linear alkanol sulfates wherein the alkanol is of 12 to 15 carbon atoms and contains from 2 to 4 ethylene oxide groups per mol and sodium higher linear alkyl benzene sulfonates wherein the higher alkyl is of 11 to 13 carbon atoms, and mixtures thereof, 4 to 10% of ethanol, 2 to 10% of a mixture of sodium chloride and sodium nitrate in which the ratio thereof is from 1:1.5 to 1.5:1 and about 34 to 59% of water.

4. A liquid detergent according to claim 3 which comprises from 30 to 405 of polyethoxylated higher linear alkanol wherein the alkanol is of an average of 12 to 13 carbon atoms and contains about 6.5 mols of ethylene oxide per mol, 5 to 10% of sodium linear dodecyl benzene sulfonate, 4 to 10% of ethanol, 2 to 6% of a mixture of sodium chloride and sodium nitrate in which the ratio thereof is from 1:1.5 to 1.5:1 and 34 to 59% of water.

5. A liquid detergent according to claim 4 which comprises about 34% of the polyethoxylated higher linear alkanol, about 8.5% of sodium linear dodecyl benzene sulfonate, about 7% of ethanol, about 4% of a mixture of sodium chloride and sodium nitrate in about a 1:1 ratio and about 46.5% of water.

6. A liquid detergent according to claim 5 which includes about 1.3% of triethanolamine and about 45.2% of water.

7. A liquid detergent according to claim 3 which comprises from 30 to 40% of polyethoxylated higher linear alkanol wherein the alkanol is of 12 to 15 carbon atoms and contains about 7 mols of ethylene oxide per mol, 5 to 10% of sodium linear dodecyl benzene sulfonate, 4 to 10% of ethanol, 2 to 6% of a mixture of sodium chloride and sodium nitrate in which the ratio thereof is from 1:1.5 to 1.5:1 and 34 to 59% of water.

8. A liquid detergent according to claim 7 which comprises about 34% of the polyethoxylated higher linear alkanol, about 8.5% of sodium linear dodecyl benzene sulfonate, about 8% of ethanol, about 4% of a mixture of sodium chloride and sodium nitrate in which the ratio thereof is about 1:1 and about 45.5% of water.

9. A liquid deterget according to claim 8 which includes about 1.3% of triethanolamine and about 44.2% of water.

10. A liquid detergent according to claim 3 which comprises from 30 to 40% of polyethoxylated higher linear alkanol wherein the alkanol is of 12 to 15 carbon atoms and contains about 7 mols of ethylene oxide per mol, 5 to 10% of sodium polyethoxy higher linear alkanol sulfate wherein the alkanol is of 12 to 15 carbon atoms and contains about 3 mols of ethylene oxide per mol, about 10% of ethanol, 6 to 10% of a mixture of sodium chloride and sodium nitrate in which the ratio thereof is from 1:1.5 to 1.5:1 and 30 to 49% of water.

11. A liquid detergent according to claim 10 which comprises about 34% of the polyethoxylated higher linear alkanol, about 8.5% of the sodium polyethoxy higher linear alkanol sulfate, about 10% of ethanol, about 6% of a mixture of sodium chloride and sodium nitrate in which the ratio thereof is of 1:1 and about 41.5% of water.

12. A liquid detergent according to claim 11 which includes about 1.3% of triethanolamine and about 40.2% of water.

13. A liquid detergent according to claim 1 which also includes from 0.1 to 5% of an alkalizing agent and 0.05 to 1.5% of fluorescent brightener(s) in replacement of equal proportions of water in the detergent formulation.

14. A liquid detergent according to claim 13 in which the alkalizing agent is triethanolamine and from 0.5 to 3% thereof is present and in which the fluorescent brightener is a mixture of such brighteners and from 0.5 to 1% of such mixture is present.

15. A liquid detergent according to claim 5 which includes about 1.3% of triethanolamine, 0.8% of a mixture of fluorescent brighteners and about 44.4% of water.

16. A liquid detergent according to claim 8 which includes about 1.3% of triethanolamine, 0.8% of a mixture of fluorescent brighteners and about 43.4% of water.

17. A liquid detergent according to claim 11 which includes about 1.3% of triethanolamine, about 0.8% of a mixture of fluorescent brighteners and about 39.4% of water.

18. A liquid detergent according to claim 1, diluted with 0.1 to 2 parts of water per part thereof.

19. A liquid detergent according to claim 1, diluted with 0.1 to 2 parts of water per part thereof.

20. A liquid detergent comprising from about 10 to 50% of a nonionic synthetic organic detergent which is a poly-lower alkoxylated higher alkanol wherein the alkanol is of 10 to 18 carbon atoms and which contains from 3 to 12 lower alkylene oxide groups per mol, 3 to 15% of a water soluble synthetic organic anionic detergent selected from the group consisting of poly-lower alkoxy higher alkanol sulfates wherein the alkanol is of 10 to 18 carbon atoms and wherein from 2 to 8 lower alkylene oxide groups are present per mol and higher alkyl benzene sulfonates wherein the higher alkyl is of 10 to 15 carbon atoms, and mixtures thereof, 4 to 10% of a lower alkanol of 2 to 3 carbon atoms or a mixture of such alkanols, 2 to 12% of a mixture of sodium chloride and sodium nitrate, wherein the proportion of sodium chloride to sodium nitrate is in the range of 1:3 to 3:1 and about 13 to 18% of water, which is a viscosity in the range of about 40 to 120 centipoises at 24° C. and which is fluid at about 7° C.

21. A liquid detergent according to claim 20, diluted with 0.1 to 2 parts of water per part thereof.

* * * * *